US010927865B2

(12) United States Patent
Neef et al.

(10) Patent No.: US 10,927,865 B2
(45) Date of Patent: Feb. 23, 2021

(54) PNEUMATIC CONTROL DEVICE AND PROCESS CONTROL DEVICE EQUIPPED THEREWITH

(71) Applicant: Festo SE & Co. KG, Esslingen (DE)

(72) Inventors: Bodo Neef, Neuhausen (DE); Christoph Maile, Hochdorf (DE)

(73) Assignee: FESTO SE & CO. KG, Esslingen (DE)

( * ) Notice: Subject to any disclaimer, the term of this patent is extended or adjusted under 35 U.S.C. 154(b) by 190 days.

(21) Appl. No.: 15/964,882

(22) Filed: Apr. 27, 2018

(65) Prior Publication Data

US 2018/0320714 A1 Nov. 8, 2018

(30) Foreign Application Priority Data

May 3, 2017 (DE) ..... 10 2017 207 414

(51) Int. Cl.
*F15B 20/00* (2006.01)
*F15B 13/04* (2006.01)
*F15B 21/00* (2006.01)

(52) U.S. Cl.
CPC ..... *F15B 20/00* (2013.01); *F15B 13/0401* (2013.01); *F15B 21/00* (2013.01); *F15B 2211/30565* (2013.01); *F15B 2211/31511* (2013.01); *F15B 2211/31576* (2013.01); *F15B 2211/41536* (2013.01); *F15B 2211/423* (2013.01); *F15B 2211/611* (2013.01); *F15B 2211/85* (2013.01); *F15B 2211/8855* (2013.01);

(Continued)

(58) Field of Classification Search
CPC ..... F15B 20/00; F15B 13/0401; F15B 21/00; F15B 2211/30565; F15B 2211/31511; F15B 2211/31576; F15B 2211/41536; F15B 2211/423; F15B 2211/611; F15B 2211/85; F15B 2211/8855; F15B 2211/895; Y10T 137/2544; Y10T 137/86574–8671; Y10T 137/87169–87241
See application file for complete search history.

(56) References Cited

U.S. PATENT DOCUMENTS 3,024,768 A * 3/1962 Shalgren ..... F15B 11/08 91/424
3,038,449 A * 6/1962 Murphy, Jr. ..... F15B 21/08 91/31

(Continued)

FOREIGN PATENT DOCUMENTS

DE 2826593 1/1980
DE 19636418 3/1998

(Continued)

*Primary Examiner* — William M McCalister
(74) *Attorney, Agent, or Firm* — Hoffmann & Baron, LLP

(57) ABSTRACT

A pneumatic control device includes a functional assembly that has an interruption valve device for the selective opening or interruption of at least one main working channel used for the pneumatic control of a pneumatic actuator. The functional assembly also contains a manually actuatable valve device that is connected to the interruption valve device by means of at least one auxiliary working channel and which enables manual pneumatic control of the connected actuator, if the at least one main working channel is interrupted by the interruption valve device at the same time. A process control device can also be equipped with a control device of this type.

22 Claims, 4 Drawing Sheets

(52) U.S. Cl.
CPC .. *F15B 2211/895* (2013.01); *Y10T 137/87507* (2015.04)

(56) References Cited

U.S. PATENT DOCUMENTS

| | | | | | |
|---|---|---|---|---|---|
| 3,580,538 | A * | 5/1971 | Wyrick | F15B 13/16 | 251/29 |
| 3,977,100 | A * | 8/1976 | Boersma | E02F 3/6481 | 37/416 |
| 4,314,502 | A * | 2/1982 | Brinkel | F15B 20/00 | 91/438 |
| 2008/0066814 | A1* | 3/2008 | Meinhof | F15B 11/006 | 137/625.64 |
| 2009/0000672 | A1* | 1/2009 | Goll | G05D 16/2024 | 137/487.5 |
| 2015/0152898 | A1* | 6/2015 | Banay | F02C 9/20 | 60/39.091 |
| 2017/0075365 | A1* | 3/2017 | Tarantino | G05D 16/202 | |
| 2018/0149174 | A1* | 5/2018 | Zapico | F15B 13/06 | |
| 2018/0252243 | A1* | 9/2018 | Pfaff | E02F 9/2292 | |
| 2018/0320714 | A1* | 11/2018 | Neef | F15B 21/00 | |

FOREIGN PATENT DOCUMENTS

| | | | | |
|---|---|---|---|---|
| DE | 102015001539 | | 8/2016 | |
| WO | WO-2015155786 | A1 * | 10/2015 | F15B 20/008 |

* cited by examiner

PNEUMATIC CONTROL DEVICE AND PROCESS CONTROL DEVICE EQUIPPED THEREWITH

BACKGROUND OF THE INVENTION

The invention relates to a pneumatic control device with a functional assembly that has an interruption valve device for the selective opening or interruption of at least one main working channel used for the pneumatic control of a pneumatic actuator. The invention further relates to a process control device equipped with a control device of this type.

A pneumatic control device of this type known from DE 10 2015 001 539 A1 contains several electrically actuatable control valves, to each of which a pneumatic actuator is connected with interpositioning of two main working channels. The control valves can drive the supply or removal of air of the actuator that occurs through the main working channels in order to drive said actuator. In order for an actuator to be able to be replaced with no interruption of the operation of the control device, an interruption valve device is connected in the main working channel leading to it, by means of which the main working channels can be interrupted if necessary.

A pneumatic control drive is known from DE 19636418 A1 that is part of a pneumatic control device that has an electropneumatic control unit in the form of a positioner. The control unit has at least one main pneumatic output that is connected to the actuator chamber of the pneumatic actuator. Depending on the feedback signals received from the actuator, which depend on the position of a drive rod, a controlled compressed air impact occurs in the actuator chamber in order to regulate the position of the actuator rod.

U.S. Pat. No. 4,314,502 A describes a safety control system in which a control valve is activated in a main working channel connected to a compressed air source that can selectively open or interrupt said main working channel. A safety control valve is connected to a branch of the main working channel by means of an intermediate channel, said safety control valve also being connected to the compressed air source via a compressed air input and blocking the intermediate channel when there is a working pressure on the compressed air source. The safety control valve can also be used to supply air to the main working channel by ventilating the compressed air input.

DE 28 26 593 A1 describes a control device for the control of an actuator. The control device has a first directional valve that is installed between a compressed air source and supply line running to the actuator and can selectively interrupt or open the supply line. Two manual switches that are also present are used to carry out a press control. If both manual switches are operated at the same time, a second directional valve switches the first directional valve from an interruption position into an open position.

US 2015/0 152 898 A1 describes a device for the emergency actuation of pneumatically or hydraulically operated drives that have several valves that can be actuated by means of fluid forces, by means of which a fluid connection to a drive is either opened or interrupted when the controls are operated accordingly.

SUMMARY OF THE INVENTION

The object of the invention is to take measures to simplify the maintenance and/or repair tasks associated with the pneumatic control device.

In order to achieve this object, it is provided in a pneumatic control device of the type mentioned at the outset for the functional assembly to have a manually actuatable valve device connected to the interruption valve device by means of at least one auxiliary working channel, by means of which manually actuatable valve device the connected actuator can only be pneumatically controlled by means of the at least one auxiliary working channel when the at least one main working channel has been interrupted by the interruption valve device.

The object is further achieved by a process control device that is equipped with a pneumatic actuator and a pneumatic control device for the actuator, wherein the pneumatic control device is designed in the above-mentioned sense and is installed on the actuator.

A pneumatic actuator connected to the at least one main working channel can be pneumatically controlled by this at least one working channel to carry out its normal operation if the working channel is opened by the interruption valve device, wherein the supply and removal of compressed air that takes place in this regard can in particular take place by means of control valve means connected to the at least one main working channel. During maintenance work, for example commissioning, replacement or repair, the interruption valve device can interrupt the at least one main working channel so that the connected actuator is pneumatically disconnected and can be maintained or even replaced independently of the control valve means. The pneumatic disconnection does not act on the other components of the control device, so that the interruption of operation for maintenance can be kept very brief. It is particularly advantageous that the interruption valve device connects the connected actuator to a further working channel designated as an auxiliary working channel when the main working channel is interrupted, which auxiliary working channel is connected to a manually actuatable valve device, the manual operation of which can be used to control the connected pneumatic actuator independently of any potentially present and due to the interruption of the main working channel disconnected control valve means individually and variably, in particular across the interruption valve device. This meets a high safety standard as pneumatic control is only possible by means of the manually actuatable valve device when the main working channel is interrupted and as a result no accidental manual interference in the control of a connected actuator can occur if this is controlled by means of the at least one opened working channel to carry out its normal operation. Advantageous further developments of the invention are described in the dependent claims.

The control device can only have a single main working channel or two main working channels, one of which is not used, in order to control what is known as a simply acting pneumatic actuator. In connection with the control of a double-acting actuator, the functional assembly of the control device is equipped with two actively usable main working channels with an interruption valve device connected in each and to which the manually actuatable valve device is connected by means of two auxiliary working channels, by means of which the connected actuator can only be pneumatically controlled when both main working channels are interrupted by the interruption valve device, in particular through the interruption valve device.

The control device can be particularly flexible in structure if the interruption valve device has its own interruption valve unit, in particular a 3/2-way valve in each case. Alternatively, the switching function for both main working channels can also be summarised in one interruption valve device that consists of a single interruption valve with higher functionality, for example a 5/3-way interruption valve.

The functional assembly is expediently equipped with externally accessible actuating means that enable easy operation of the manually actuatable valve device. These actuating means can be arranged separately from the manually actuatable valve device. Depending on the type of manually actuatable valve device, the actuating means can be mechanically, electrically or pneumatically coupled to the manually actuatable valve device for the transmission of actuating signals to the manually actuatable valve device.

The manually actuatable valve device is for example of a type that can be directly mechanically switched by means of the manual operation of the actuating means.

The manually actuatable valve device can also for example be of a type that can be indirectly electrically or pneumatically actuated by means of direct manual actuation of the actuating means. For example, the manually actuatable valve device is of an electropneumatically pre-controlled type in which electrical actuating signals can be generated through manual operation that activate an electrically actuatable pre-control device in the manually actuatable valve device, causing a pneumatic switching of the manually actuatable valve device.

The manually actuatable valve device is expediently designed to either cause a supply or an removal of air or a blocking of each auxiliary working channel. In the event of the presence of two auxiliary working channels, both auxiliary working channels can expediently be blocked at the same time by means of the manually actuatable valve device.

The functional assembly can act as a pneumatic switch by means of the at least partially individually piped or connected valve means. Particularly advantageous, however, is the implementation of the functional assembly as a functional model that can be handled in a uniform manner, which also offers the advantageous possibility of combination with other functional modules in the pneumatic control device.

The manually actuatable valve device expediently has a basic setting stipulated by springs. In a preferred embodiment, this basic setting is a fully blocked setting in which each auxiliary working channel is blocked. This means that when switching the interruption valve device into a position that interrupts the at least one main working channel the actuator is initially inactive and does not experience any compressed air exchange. This can be called the "freeze" position of the actuator. Only afterwards can the drive be activated by means of manual actuation of the manually actuatable valve device.

Alternatively, the basic setting of the manually actuatable valve device can also be an air passage position in which at least one auxiliary working channel is subject to air being supplied or removed such that the actuator is actuatable directly through the at least one auxiliary working channel and in particular travels into a final position when the connected actuator is connected to the at least one auxiliary working channel by means of a switching of the interruption valve device.

The functional assembly of the control device expediently has an air input connection with a supply channel which can connect a compressed air source that provides the compressed air intended for the at least one main working channel, in particular by being connected to a control valve device that is able to control the fluid impact with respect to the at least one main working channel. A shut-off valve is expediently allocated to the supply channel, by means of which the fluid connection to the at least one main working channel or to the control valve device that may be present can selectively be blocked or opened. The shut-off valve device is in particular designed to block the fluid connection at the at least one main working channel or to the control valve means that may be present if the main working channel is blocked by the interruption valve device at the same time. The shut-off valve can also open this above-mentioned fluid connection if the main working channel has also been opened by the interruption valve device. In this way, there is advantageously an option to block the fluid channels of the functional assembly such that control valve means connected to it or other control components are connected by means of fluid and for example can be removed for maintenance purposes without having any impact on the current operating situation of a connected actuator.

The functional assembly is expediently equipped with actuating means, by means of which each interruption valve device and also the shut-off valve device can be actuated at the same time so that either both each main working channel and the fluid connection from the supply channel to each main working channel are blocked at the same time or each main working channel and the fluid connection from the supply channel to each main working channel are opened at the same time. The actuating means are expediently of a type that can be manually actuated. They can in particular be designed for mechanical, electrical or pneumatic transmission of the actuation commands depending on the type of interruption valve device and the shut-off valve device.

Each main working channel preferably has a main working output for the connection of a pneumatic actuator and a main working input that can selectively set to supply or remove air to control the actuator. The interruption valve device found in each main work channel is designed to connect the main working output to the main working input in one working position with the simultaneous separation of the auxiliary working channel and to connect the main working output to the auxiliary working channel in an interruption position with the simultaneous separation of the main working input. If the interruption valve device is in the interruption position, manual control of the actuator connected to the main working output is achieved by means of the auxiliary working channel that is then connected to the main work output and the manually actuatable valve device allocated to this auxiliary working channel.

The functional assembly is expediently equipped with a supply channel connected to the manually actuatable valve device which is connected to an external compressed air source when the pneumatic control device is operated by means of an air input connection of the functional assembly such that it provides the compressed air intended for the at least one auxiliary working channel. This supply channel preferably also supplies the compressed air for the pneumatic control of the actuator achieved by means of the at least one main working channel.

The pneumatic control device is expediently equipped with an electropneumatic control unit that contains control electronics for the processing of feedback signals from the actuator and control valve means that can be electrically actuated by the actuation electronics, wherein each main working channel is connected to the control valve means. The control valve means are intended to pneumatically control the connected actuator during the normal operation phase of the pneumatic control device when the manually actuatable valve device is inactive.

The electropneumatic control unit can have different functional forms. It can for example be designed for unregulated control of the control valve means, wherein simple sensor signals that are generated depending on certain positions of an actuating unit of the actuator are fed into it as feedback signals. Particularly advantageous is a design of the electropneumatic control unit as a positioner unit that could also be called a positioner, the control electronics of which has a regulation functionality in order to operate the actuator in a regulated manner, in particular by regulating the position of a mobile actuating unit of the actuator. In this case, the control electronics expediently have a set value input by means of which it receives its set values from an external electronic control device. The position regulation unit then uses these to regulate the position of the connected actuator.

The electrically actuatable control valve means can consist of just a single control valve or a group of control valves. The control valve means preferably have a constant functional characteristic or are designed for pulse width modulated operation. They can be designed for direct actuation by means of the control signals provided by the control electronics or can be of an electropneumatically pre-controlled construction type. It is advantageous if the positioner unit contains an e/p converter as a pre-control stage which in particular works according to the nozzle deflector plate principle.

The electropneumatic control unit is expediently designed as a control module that is detachably connected to the functional assembly of the pneumatic control device, which is particularly favourable if the functional assembly is created as a functional module that can be handled in a uniform manner. If the control device is switched to an operating mode in which the main working channels and the fluid connection between a supply channel and the control valve means is interrupted, the control module can be disassembled in order to be replaced or for maintenance purposes. Even when the control module is disassembled, however, there is still an advantageous option for manual control of the actuator by means of the corresponding actuation of the manually actuatable valve device.

The pneumatic control device can be used to control any processes. It is also preferably part of a process control device, like an actuator to be controlled.

It is further advantageous if the actuator is part of a process valve and is used to actuate a valve armature of the process valve that can be arranged in the progression of a pipe of a for example biological, chemical or biochemical plant in order to regulate the flow of a process medium.

BRIEF DESCRIPTION OF THE DRAWINGS

The invention is explained in more detail in the following with reference to the attached drawing, in which.

DETAILED DESCRIPTION

Figure 1:
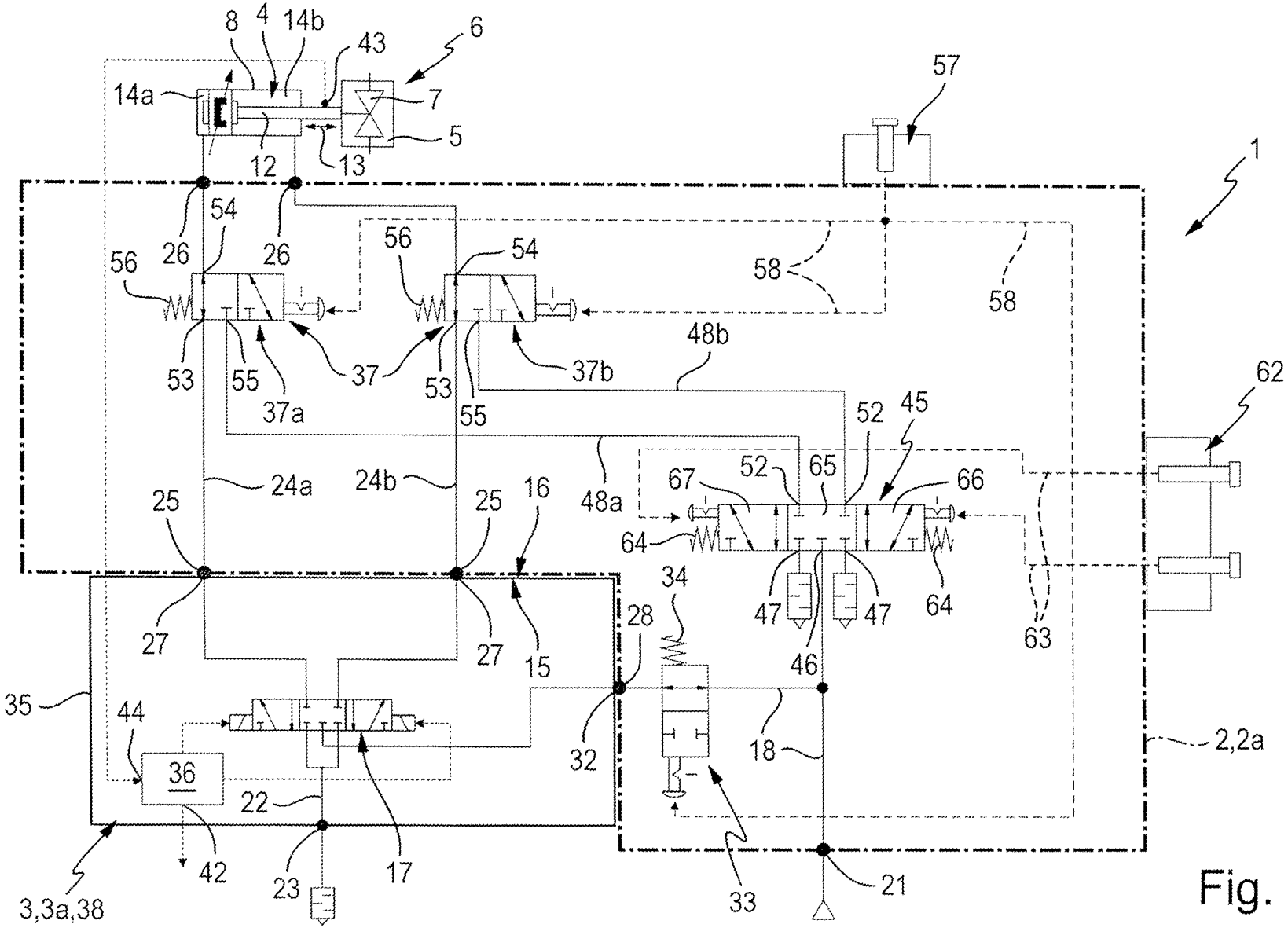
FIG. 1 shows the circuit diagram of a preferred embodiment of the pneumatic control device according to the invention as part of a preferred embodiment of the process control device according to the invention, wherein the dot-dashed component represents a functional assembly of the control device, in particular one designed as a functional module, and FIGS. 2-7 each show a simplified representation of the circuit diagram in FIG. 1 in different operational phases, wherein channels to which air is currently being supplied and consequently impacted by compressed air are identified by an uninterrupted channel progression with thick line width, wherein channels from which air is currently being removed are labelled with a thin, solid line, and wherein channels which are currently blocked to prevent the passage of air are identified by a dashed line.

The preferred embodiment of a pneumatic control device 1 illustrated in the drawing is expediently part of a process control device 10 labelled with the reference number 10 and has as its main components a functional assembly 2 shown surrounded by a dot-dashed line and an electropneumatic control unit 3 preferably detachably mounted on the functional assembly 2.

The process control device 10 further includes a process valve 6 only indicated schematically that has a valve fitting 5 and a pneumatic actuator 4 that combines with the valve fitting 5 to form an assembly.

The valve fitting 5 is provided for integration into the progression of a pipe and has a valve seat 7 arranged in a fitting housing and can be positioned in various positions to control the passage of a fluid process medium through the valve fitting 5.

The pneumatic actuator 4 has an actuator housing 8, by means of which it is fixed to the fitting housing of the valve fitting 5. A mobile actuating unit 12 of the actuator 4 extends into the actuator housing 8 and is coupled in terms of movement to the valve seat 7 and can be initiated to carry out an actuating movement 13 in the direction indicated by the double arrow by means of the pneumatic control of the actuator 4, said actuating movement being able to be changed by the position of the valve seat 7.

By way of an example, the actuator 4 is designed as a linear actuator in which the actuating movement 13 is a linear movement. A first and a second actuating chamber 14*a*, 14*b* are designed inside the actuator housing 8, which actuating chambers are separated from one another by actuating pistons that belong to the actuating unit 12 such that a tailored supply and removal of compressed air into and from the two actuating chambers 14*a*, 14*b* can cause the actuating movement 13 in one direction or the other. By setting corresponding pressure ratios, the actuating unit 12 and therefore the valve seat 7 can also be positioned in any position with no graduations.

According to an exemplary embodiment that is not shown, the actuator 4 is a rotary actuator. In this case, a rotary vane is generally provided as a valve seat 7, while the valve seat 7 in the exemplary embodiment is in particular a flat slide.

An assembly interface that can no longer be seen in the drawing is formed on the actuator 4, in particularly externally on its actuator housing 8, by means of which assembly interface the process valve 6 is preferably installed in a detachable manner on the pneumatic control device 1.

Within a process control device 10 according to the invention the actuator 4 can also be provided for purposes other than the formation of a process valve 6, for example for the actuation and/or positioning of other system components.

The electropneumatic control device 3, hereinafter referred to simply as control unit 3 for reasons of simplification, is expediently formed as a control module 3*a* that can be handled in a uniform manner in which all of the components that belong to the control unit 3 are summarised in an assembly.

Something comparable expediently occurs in the functional assembly 2. This is expediently designed as a functional module 2*a* that can be handled in a uniform manner that can very easily be combined with other functionalities to form a functional modular assembly. The control device 1 can also have several functional modules with functionalities that deviate from one another that are preferably flange-mounted on one another in a detachable manner and expediently communicate with one another using fluid.

A first assembly interface 15 is formed on the functional assembly 2 to which the control unit 3 is detachably fixed with an adapted second assembly interface 16. Suitable fixing means such as screw connection means and/or snap-lock means are not shown in the drawing.

The control unit 3 is equipped with electrically controllable and therefore actuatable control valve means 17. These are connected to a supply channel 18 formed in the functional assembly 2 in which compressed air provided by an external compressed air source can be fed in by means of an air input connection 21 that is preferably formed on an external surface of the functional assembly 2.

The control valve means 17 are also connected to an air outlet channel 22 that communicates with the atmosphere by means of at least one air outlet opening 23, wherein the air outlet opening 23 is preferably arranged on the control unit 3 but alternatively can also be found on the functional assembly 2.

While the compressed air needed to supply air to the actuator 4 is supplied via the supply channel 18, air is removed from the actuator 4 by means of the air outlet channel 22.

Two pneumatic working channels are connected to the control valve means 17 that are labelled as the first and second main working channels 24*a*, 24*b* for better differentiation. Each main working channel 24*a*, 24*b* traverses functional assembly 2 and has a main working input 25 that can be connected or is connected to the control valve means 17 and a main working output 26 connected to one of the two actuating chambers 14*a*, 14*b* of the actuator 4. The main work inputs 25 are expediently provided on the first assembly interface 15 and communicate with a connection opening 27 formed in each case on the second assembly interface 16 when the control unit 3 is mounted on the first assembly interface, said connection opening being a component of the control valve means 17 or connected to the control valve means 17 by means of an internal channel of the control unit 3. The connection openings 27 can in particular be connected to the control valve means 17 by means of special channel connections inside the control unit 3.

The supply channel 18 formed in the functional assembly 2 is connected to an air discharge connection 28 that is also formed on the first assembly interface 15, said air discharge connection communicating with an input opening 32 formed on the second assembly interface 16 when the control unit 3 is mounted on the functional assembly 2, said input opening being a component of the control valve means 17 or connected to the control valve means 17 by means of an internal channel in the control unit 3.

A shut-off valve device 33 connected to the supply channel 18 can selectively take on a blocked or a opened position. When it is in the open position it opens the fluid connection between the air input connection 21 and the air output connection 28 connected to the control valve means 17 while in the blocked position it blocks this fluid connection so the control means 17 are disconnected from the supply channel 18 and consequently from the compressed air source 21 connected to this.

When it is not actuated the shut-off valve device 33 is expediently pre-tensioned in a basic setting which is the blocked position. The pre-tension required for this is provided by the spring means 34.

The control unit 3 expediently has a control unit housing 35 in which the control valve means 17 can be found and also has control electronics 36 connected to the control valve means 17 by means of control technology. The connection openings 27 and the input opening 32 are arranged on an external surface of the control unit housing 35.

The control electronics 36 provide electrical control signals for the electrically actuatable control valve means 17 to specify their operating status. Depending on the operating status currently set out, the control valve means 17 provide a fluid connection of one or both main work inputs 25 to either the supply channel 18 or the air outlet channel 22 or they separate both main working inputs 25 from both the supply channel 18 and the air outlet channel 22. In this way, the compressed air provided by the supply channel 18 can selectively be fed into each actuating chamber 14*a*, 14*b* for the supply or removal of air to or from each actuating chamber 14*a*, 14*b*. There is also an option to block the compressed air in the actuating chambers 14*a*, 14*b*. In this way the actuating direction 13 can be triggered in one direction or the other or be stopped at any point.

This functionality is only achieved if an interruption valve device 37 arranged in the progression of the two main working channels 24*a*, 24*b* takes on a switching position called an open position in which it opens the passage of fluid through each of the main working channels 24*a*, 24*b*.

The control valve means 17 of the exemplary embodiment are designed as proportional valve means and consequently permit a constant change in the flow cross section made available to the flowing compressed air. By way of an example, the control valve means 17 have a 5/3 valve function.

An alternative embodiment of the control valve means 17 (not shown) contains several switching valves that can be actuated in a pulse width modulated manner.

The control valve means 17 can for example be designed as magnetic valve means or as piezo valve means for their electrical activation ability. They can be directly electrically actuated but are preferably of an electrically pre-controlled construction type in line with the exemplary embodiment. Electrically controllable pre-control means in the control valve means 17 can for example be designed as e/p converters according to the nozzle-deflecting plate principle.

The control electronics 36 expediently have a regulatory functionality, which is the case in the exemplary embodiment. This makes regulated operation of the actuator 4 possible, in particular operation in which the position is regulated. In this case, the control unit 3 also represents a positioner unit 38 that can also be called a positioner.

The control electronics 36 have a set value input 42 by means of which set value signals that correspond to the desired target position of the actuating unit 12 or the valve seat 7 coupled to this in terms of movement can be supplied from externally. In order to do this, the set value input 42 is connected to an external electronic control device (not shown).

The knowledge of the actual position of the actuating unit 12 and the valve seat 7 needed to regulate the position is created for the control electronics 36 in the form of feedback means 43 that cooperate with the actuating unit 12 or with the valve seat 7 and are connected to a feedback signal input 44 of the control electronics 36. The feedback means 43 are able to provide continuous position information on the actuating unit 12 or the valve seat 7 to the control electronics 36 as electrical signals. Depending on the result of the comparison between the set values fed to the control electronics 36 and the actual values, the control electronics 36 electronically control the control valve means 17 to actuate the actuator 4 accordingly.

In a simpler embodiment (not shown), the control electronics 36 do not have a regulatory function so they can only carry out unregulated control of the actuator 4, wherein singular sensor signals are processed in particular as feedback signals.

The functional assembly 2 has a manually actuatable valve device 45 that can be actuated separately and independently of the interruption valve device 37. This manually actuatable valve device 45 is connected to a supply channel 18 connected to an external compressed air source, which supply channel is expediently the same supply channel 18 that also supplies the control valve means 17 with compressed air. The manually actuatable valve device 45 has a supply connection 46 to connect to the supply channel 18.

The manually actuatable valve device 45 also has two removal of air connections 47 that communicate with the atmosphere but can also be combined in a single removal of air connection.

Two working channels are also connected to the manually actuatable valve device 45, called first auxiliary working channel 48*a* and second auxiliary working channel 48*b* for better differentiation. Each of these two auxiliary working channels 48*a*, 48*b* is connected to the manually actuatable valve device 45 by means of one of two output connections 52. The two auxiliary working channels 48*a*, 48*b* are present in addition to the two main working channels 24*a*, 24*b*.

The interruption valve device 37 has one interruption valve unit 37*a*, 37*b* per main working channel 24*a*, 24*b*, which in the case of the first main working channel 24*a* is known as the first interruption valve unit 37*a* and in the case of the second main working channel 24*b* is known as the second interruption valve unit 37*b*.

Both interruption valve units 37*a*, 37*b* are preferably formed as independent valves that can in principle be actuated independently of one another. This applies to the exemplary embodiment shown. Alternatively, the two interruption valve units 37*a*, 37*b* can also be integral components of a single interruption valve that has correspondingly higher valve functionality.

Each of the two interruption valve units 37*a*, 37*b* preferred has a 3/2 valve function, a fact which is true of the exemplary embodiment illustrated.

Each interruption valve unit 37*a*, 37*b* has a main valve input 53 connected to the allocated main working input 25, a main valve output 54 connected to the main working output 26 and an auxiliary valve connection 55 to which one of the two auxiliary working channels 48*a*, 48*b* is connected, the other end of which is connected to one of the two output connections 52 of the manually actuatable valve device 45.

In an open position that can be seen in FIG. 1, the interruption valve unit 37*a*, 37*b* opens the fluid passage through the allocated main working channel 24*a*, 24*b* and at the same time separates the auxiliary working channel 48*a*, 48*b* connected to the same interruption valve unit 37*a*, 37*b* from the allocated main working channel 24*a*, 24*b* such that there is no fluid connection to either the main working output 26 or the main working input 25.

In an alternative possible interruption position of the interruption valve unit 37 in which both interruption valve units 37*a*, 37*b* take on an interruption position with regard to the allocated main working channel 24*a*, 24*b* and separate the main working input 25 from the main working output 26, the main working output 26 of the first main working channel 24*a* is connected to the first auxiliary working channel 48*a* by means of the auxiliary valve connection 55 while at the same time the main working output 26 of the second main working channel 24*b* is connected to the second auxiliary working channel 48*b* by means of the auxiliary valve connection 55 of the second interruption valve unit 37*b*.

Both of the interruption valve units 37*a*, 37*b* expediently take on a defined basic position when they are not being actuated, which is an interruption position. The basic setting is in particular pre-tensioned by means of spring means 56.

The functional assembly 2 has first actuating means 57 that are functionally connected to the interruption valve device 37 and the shut-off valve device 33 and by means of which the interruption valve device 37 and the shut-off valve device 33 can be actuated at the same time. When the first actuating means 57 are deactivated, both the interruption valve device 37 and the shut-off valve device 33 take on the open position. By activating the first actuating means 57, these valve devices 37, 33 can be switched at the same time so the interruption valve device 37 takes on the interruption position and the shut-off valve device 33 takes on the blocking position.

The first actuating means 57 are in particular of a manually actuatable type and contain for example switching means that can selectively be positioned in one of two switch positions, for example a rocker switch. The first actuating means 57 are coupled to the valve devices 37, 33 for actuation by means of first actuating means 58, wherein the first actuating means 58 are for example of a mechanical type but can easily also be designed to be electrical or electropneumatic if the valve devices 37, 33 are of an electrically or pneumatically actuatable construction type.

The functional assembly 2 is preferably designed such that when the first actuating means 57 are deactivated the interruption valve device 37 and the shut-off valve device 33 are in the open position and when the first actuating means 57 are activated the interruption valve device 37 is in the interruption position and the shut-off valve 33 is in the blocking position.

In the interruption position of the interruption valve device 37 the main working input 25 is not only separated from the main working output 26, it is also separated from the interruption valve unit 37*a*, 37*b* connected to the first or second auxiliary working channel 48*a*, 48*b*. In this way, the control unit 3 can be removed from the functional assembly 2 when the first actuating means 57 are activated without this impacting the functional assembly 2.

The manually actuatable valve device 45 is allocated to second actuating means 62 for manual actuation, which second actuating means are expediently arranged on functional assembly 2 in a manner that is accessible from outside for an operator, like the first actuating means 57. The second actuating means 62 are coupled to the manually actuatable valve device 45 for actuating purposes by means of second actuating means 63 in the functional assembly 2 in order to exert a switching force on the manually actuatable valve device 45. The second actuating means 63 can be of the same type as the first actuating means 58 described above using the first actuating means 57.

The manually actuatable valve device 45 preferably has three positions. A first switching position that can be seen in FIG. 1 is preferably designed as a full blocking position 65 in which both auxiliary working channels 48*a*, 48*b* are blocked and separated from both the supply connection 46 and from the removal connections 47. This full blocking position 65 is preferably a basic position of the manually actuatable valve device 45 that is not actuated by the second actuating means 62 and that in particular is evoked by spring means 64.

Two further possible switch positions of the manually actuatable valve device 45 are defined by a first and a second air passage position 66, 67. In the first air passage position 66, the first auxiliary working channel 48*a* is connected to the supply channel 18 and the second auxiliary working channel 48*b* is connected to one of the removal connections 47. In the second air passage position 67, the second auxiliary working channel 48*b* is connected to the supply channel 18 while air is supplied to the second auxiliary working channel 48*b* by means of a connection to a removal connection 47.

In this way, air can be supplied to or removed from two auxiliary working channels 48*a*, 48*b* opposite to one another in an alternating manner by means of the corresponding actuation of the manually actuatable valve device 45 or they can be blocked at the same time.

Due to the presence of the interruption valve device 37, the operating condition of the manually actuatable valve device 45 only acts on the main working outputs 26 or the connected pneumatic actuator 4 when the interruption valve device 37 or its interruption valve units 37*a*, 37*b* are switched by means of the activation of the first actuating means 57 in the interruption position. The pneumatic control function of the manually actuatable valve device 45 with respect to the actuator 4 can also only be achieved if the main working channels 24*a*, 24*b* are interrupted and the control unit 3 cannot have any impact on the operating condition of the connected actuator 4.

The pneumatic control device 1 therefore offers the option to either control the connected actuator 4 by means of the control unit 3 by fluid flow through the open main working channels 24*a*, 24*b* or alternatively by means of the manually actuatable valve device 45 by fluid flow through the two auxiliary working channels 48*a*, 48*b* and through the interruption valve device 37. The interruption valve device 37 excludes the possibility of both control options being available at the same time. In particular, this excludes the possibility of accidental manual actuation by means of the manually actuatable valve device 45 during automatic operation effected by the control unit 3.

In particular, it is provided for the functional assembly 2 to have a manually actuatable valve device 45 connected to the interruption valve device 37 by means of at least one auxiliary working channel 48*a*, 48*b*, by means of which manually actuatable valve device 45 the connected actuator 4 can be pneumatically controlled via the at least one auxiliary working channel 48*a*, 48*b* and through the interruption valve device 37 only when the at least one main working channel 24*a*, 24*b* has been interrupted by the interruption valve device 37.

The connected actuator 4 is connected to the at least one auxiliary working channel 48*a*, 48*b* by the interruption valve device 37 when the main working channel 24*a*, 24*b* is interrupted by the interruption valve device 37.

Various possible operating conditions of the pneumatic control device 1 and a process control device 10 equipped with this are shown in FIGS. 2 to 7.

Figure 2:
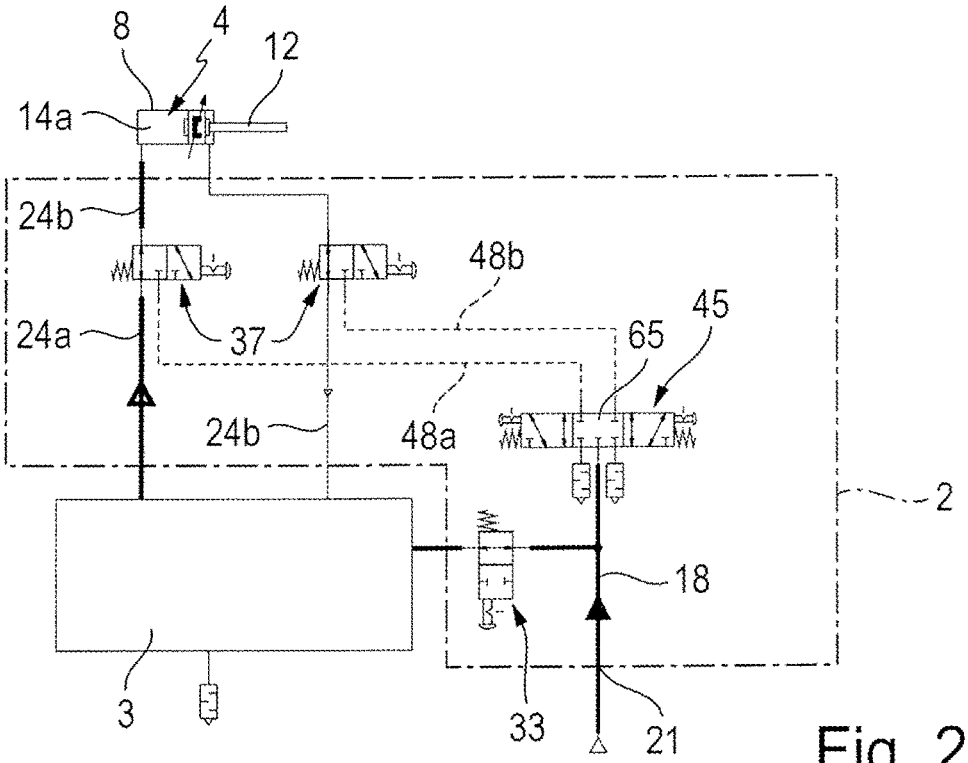
Figure 3:
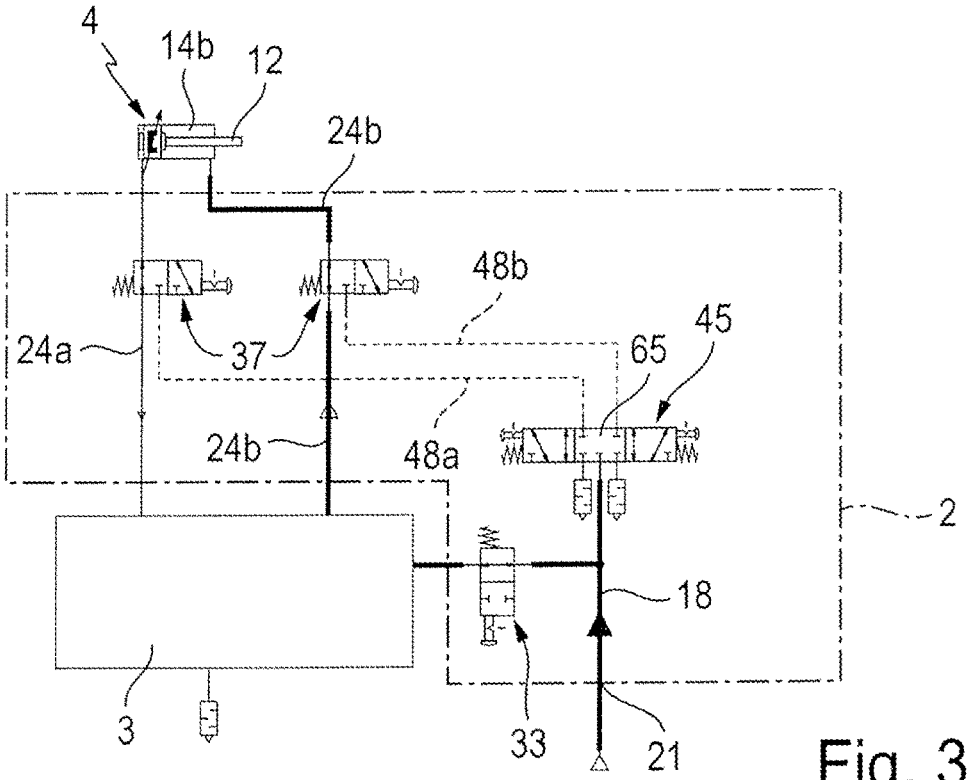

FIGS. 2 and 3 each illustrate an operating phase in electronically controlled automatic operation effected by the control unit 3. Here, the interruption valve device 37 is in the open position and the air is either removed from the actuator 4 according to FIG. 2 through the first main working channel 24*a* or according to FIG. 3 by the second main working channel 24*b*, wherein air is supplied to it by the other working channel 24*b* or 24*a* at the same time. This results in an actuating movement 13 in one or the other direction, wherein by way of an example the actuating unit 12 either moves out of the actuator housing 8 or into the actuator housing 8. The manually actuatable valve device 45 takes on the full blocking position 65 in each case. If the manually actuatable valve device 45 switches into its air passage positions 66, 67 in one of these operating conditions, this results in the supply and removal of air to or from the connected auxiliary working channels 48*a*, 48*b*, although this would not have an effect on the actuator 4 due to the separation of the two main working channels 24*a*, 24*b*.

Figure 4:
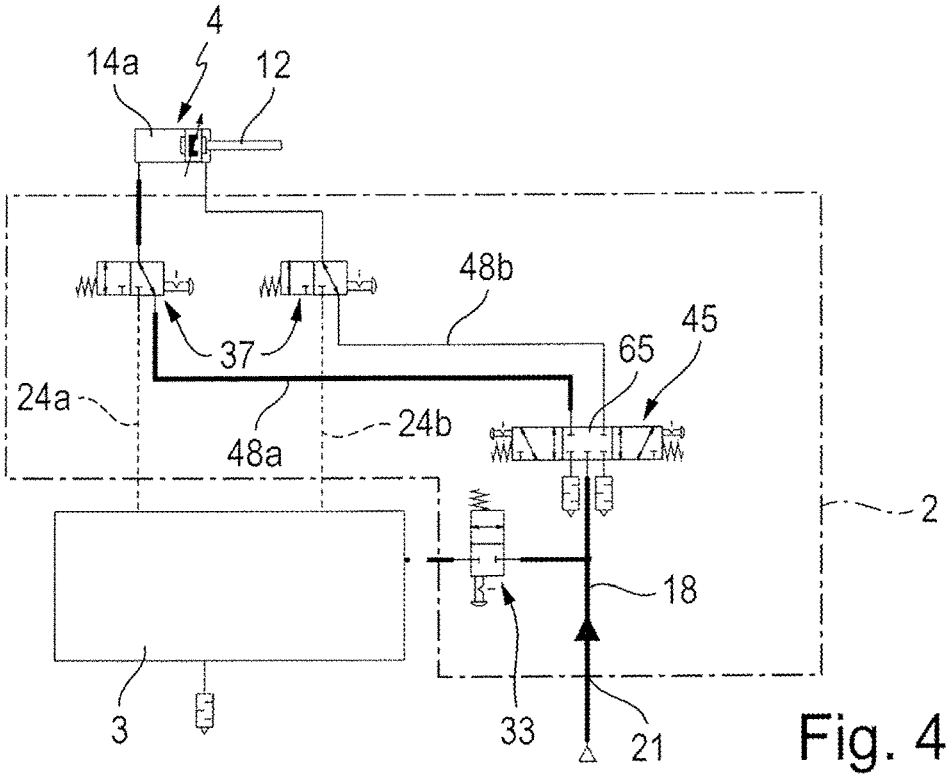
Figure 6:
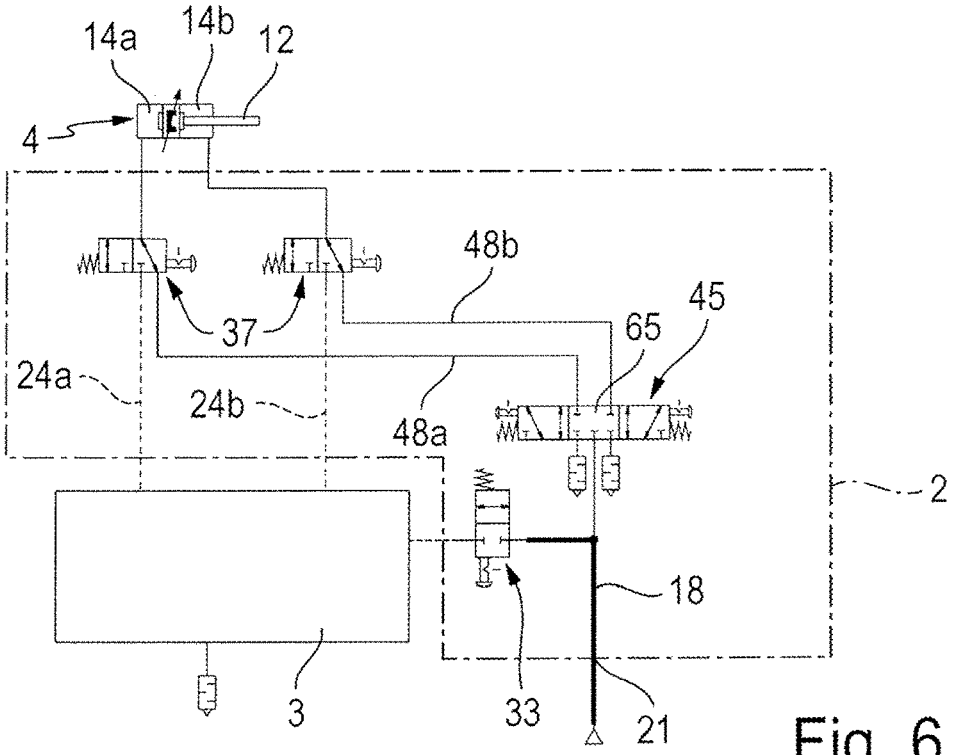
Figure 7:
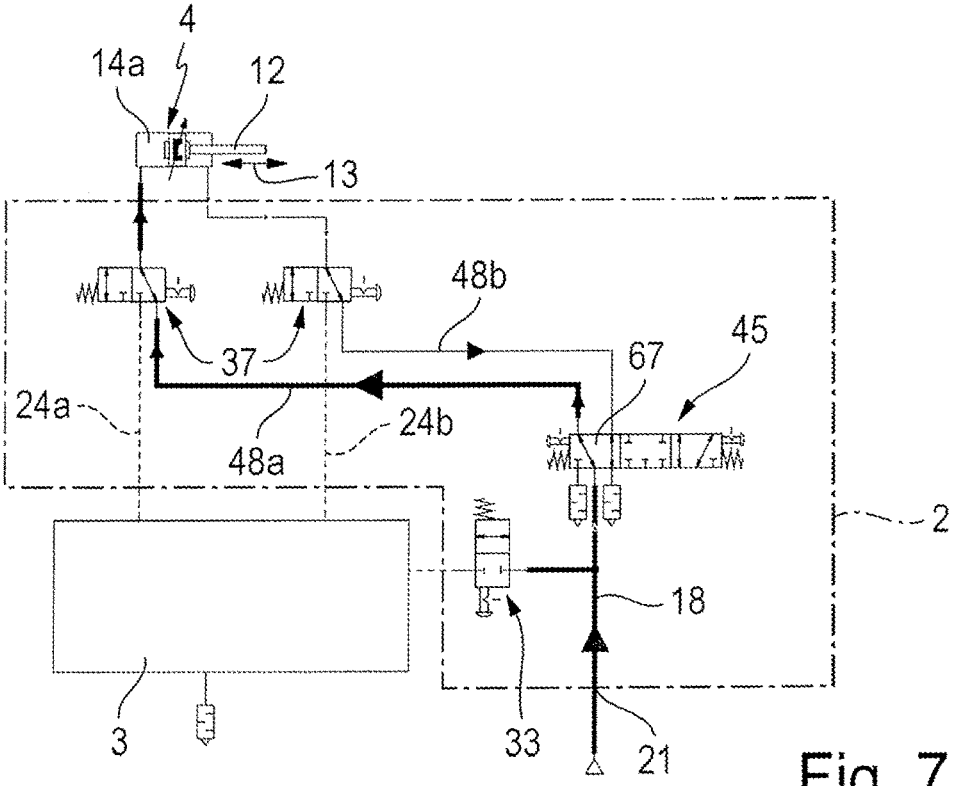

The operating phase shown in FIG. 4 results from the operating phase shown in FIG. 2 through the switching of the interruption valve device 37 into the interruption position and simultaneous switching of the shut-off valve device 33 into the blocking position. Since the manually actuatable valve device 45 is in its fully blocked position here too, the actuator 4 and the control unit 3 are functionally uncoupled from one another and both components can be removed from the functional assembly 2 as needed. Above all, however, on the basis of this operating phase illustrated in FIG. 4, it is possible to control the actuator 4, which is still connected, manually independently of the control unit 3 using the manually actuatable valve device 45 and to move and position the actuating unit 12 as needed. The manual control options are illustrated in FIGS. 5 to 7.

Figure 5:
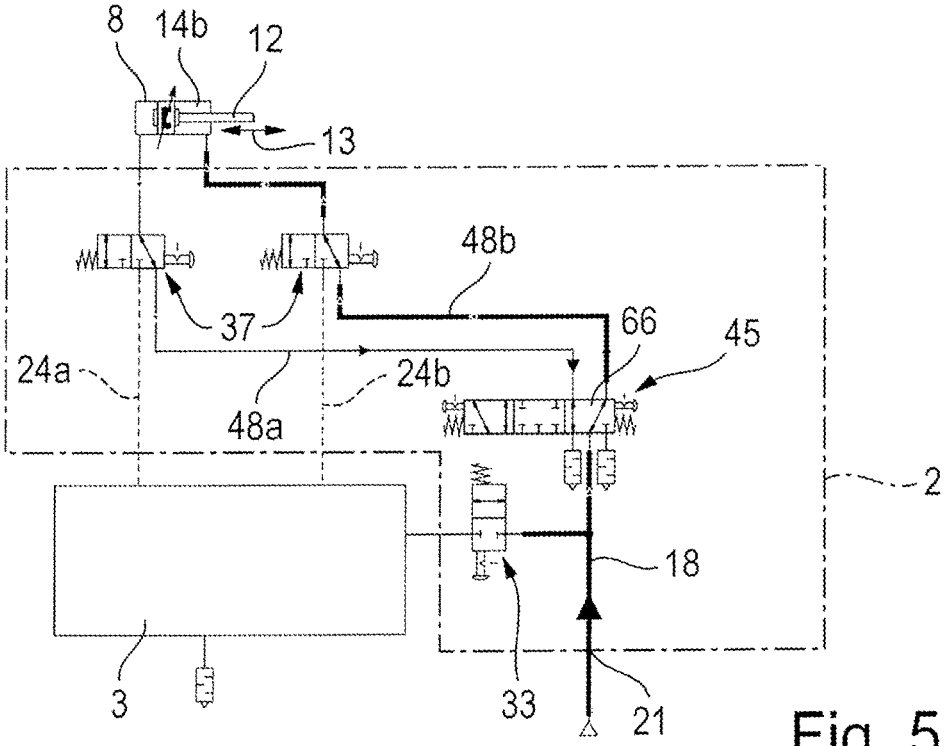

During the operating phase shown in FIG. 5, the manually actuatable valve device 45 is in the first air passage position 66 so the actuating unit 12 is actuated in an actuating direction 13 that moves into the actuator housing 8. In an operating phase that can be seen from FIG. 6, the switch positions of which correspond to those in FIG. 4, the manually actuatable valve device 45 is in the full blocking position 65 so the actuator 4 is in a "freeze" condition in which the actuating unit 12 is held in the current position. During the operating phase shown in FIG. 7, the manually actuatable valve device 45 is in the second air passage position 67 so the actuating unit 12 is actuated in an actuating direction 13 that moves out of the actuator housing 8.

In an exemplary embodiment (not shown) that relates to the control of a single-acting actuator 4, the functional assembly 2 is equipped with just one main working channel connected in the above-mentioned sense so the switching function of the interruption valve device 37 and the manually actuatable valve device 45 only relates to one auxiliary working channel. As a result, one of the two interruption valve units 37*a* or 37*b* is not necessary in the interruption valve device 37 and the manually actuatable valve device 45 can be reduced from 5/3 valve functionality to 3/3 valve functionality.

In an exemplary embodiment (not shown), none of the air passage positions 66, 67 is defined as a basic position of the manually operated valve device 45 predetermined by spring means. This means that when the interruption valve device 37 is switched to the interruption position, the actuating unit 12 of the connected actuator 4 immediately moves into a defined stroke end position.

What is claimed is:

1. A pneumatic control device with a functional assembly having an interruption valve device for the selective opening in an open position or interruption in an interruption position of at least one main working channel used for the pneumatic control of a connected pneumatic actuator, wherein the functional assembly has a manually actuatable valve device connected to the interruption valve device by means of at least one auxiliary working channel, wherein the connected pneumatic actuator can be pneumatically controlled via the at least one auxiliary working channel by means of the manually actuatable valve device only when the at least one main working channel is interrupted by the interruption valve device, wherein air can be supplied to or removed from the at least one auxiliary working channel by actuation of the manually actuatable valve device when the interruption valve device is in the interruption position to pneumatically control the pneumatic actuator, and wherein the functional assembly further comprises a first actuating means separate from the manually actuatable valve device, the first actuating means being functionally connected to the interruption valve device for switching the interruption valve device to either the open position or the interruption position independent of the manually actuatable valve device, and without using the air which is supplied to or removed from the at least one auxiliary working channel via the manually actuatable valve device.

2. The pneumatic control device according to claim 1, wherein the functional assembly has two main working channels for the control of a double-acting pneumatic actuator, in each of which main working channels the interruption valve device is arranged, wherein the manually actuatable valve device is connected to the interruption valve device by means of two auxiliary working channels, wherein the connected pneumatic actuator can be pneumatically controlled by means of the manually actuatable valve device only when both main working channels are interrupted by the interruption valve device.

3. The pneumatic control device according to claim 2, wherein the interruption valve device has a separate interruption valve unit for each main working channel.

4. The pneumatic control device according to claim 1, wherein the functional assembly has an externally accessible second actuating means for the manual actuation of the manually actuatable valve device.

5. The pneumatic control device according to claim 1, wherein the manually actuatable valve device is designed to be able to effect either the supply of air to or the removal of air from or a blocking of each auxiliary working channel.

6. The pneumatic control device according to claim 5, wherein, in case of the presence of two auxiliary working channels, both auxiliary working channels are able to be blocked at the same time.

7. The pneumatic control device according to claim 1, wherein the functional assembly is designed as a functional module that can be handled in a uniform manner.

8. The pneumatic control device according to claim 1, wherein the manually actuatable valve device has a basic setting predefined by spring means.

9. The pneumatic control device according to claim 8, wherein each auxiliary working channel is blocked in the basic setting.

10. The pneumatic control device according to claim 1, wherein the functional assembly has a supply channel that can be connected to a compressed air source by means of an air input connection, by means of which supply channel the compressed air intended for the at least one main working channel can be provided and to which supply channel a shut-off valve device for the selective blocking or opening of the fluid connection to the at least one main working channel is allocated, wherein the shut-off valve device on the one hand is able to block the fluid connection if also the at least one main working channel is blocked by the interruption valve device and on the other hand is able to open the fluid connection if also the at least one main working channel is opened by the interruption valve device.

11. The pneumatic control device according to claim 10, wherein the first actuating means of the functional assembly is also connected to the shut-off valve device for simultaneously actuating the interruption valve device and the shut-off valve device in such a manner that either each main working channel and the fluid connection from the supply channel to each main working channel is blocked at the same time or each main working channel and the fluid connection from the supply channel to each main working channel is opened at the same time.

12. The pneumatic control device according to claim 11, wherein the first actuating means are designed to be manually actuatable.

13. The pneumatic control device according to claim 1, wherein each main working channel has a main working output for the connection of a pneumatic actuator and a main working input to which or from which air can selectively be supplied or removed to control the pneumatic actuator, wherein, in an open position, the interruption valve device arranged in the respective main working channel connects the main working output to the main working input with simultaneous separation of the allocated auxiliary working channel and, in an interruption position, connects the main working output to the allocated auxiliary working channel with simultaneous separation of the main working input, such that the auxiliary working channel can both be supplied with air and have air removed from it for the manual control of the pneumatic actuator connected to the main working output separated from the main working input by means of the manually actuatable valve device.

14. The pneumatic control device according to claim 13, wherein the functional assembly has a supply channel that is connected to the manually actuatable valve device and can be connected to a compressed air source by means of an air input connection, by means of which supply channel the compressed air intended for the at least one auxiliary working channel can be provided.

15. The pneumatic control device according to claim 13, wherein the functional assembly has a supply channel that can be connected to a compressed air source by means of an air input connection, by means of which supply channel the compressed air intended for the at least one main working channel can be provided and to which supply channel a shut-off valve device for the selective blocking or opening of the fluid connection to the at least one main working channel is allocated, wherein the shut-off valve device on the one hand is able to block the fluid connection if also the at least one main working channel is blocked by the interruption valve device and on the other hand is able to open the fluid connection if also the at least one main working channel is opened by the interruption valve device, and wherein one and the same supply channel is designed to be used for compressed air supply to both the at least one main working channel and the at least one auxiliary working channel.

16. The pneumatic control device according to claim 1, further comprising an electropneumatic control unit that contains a control electronics designed for the processing of feedback signals from the pneumatic actuator and contains control valve means that can be electrically controlled by the control electronics, wherein each main working channel is connected to the control valve means.

17. The pneumatic control device according to claim 16, wherein the electropneumatic control unit is designed as a positioner unit, the control electronics of which have a regulatory function.

18. The pneumatic control device according to claim 17, wherein the regulatory function is a position regulation function.

19. The pneumatic control device according to claim 16, wherein the functional assembly has a supply channel that can be connected to a compressed air source by means of an air input connection, by means of which supply channel the compressed air intended for the at least one main working channel can be provided and to which supply channel a shut-off valve device for the selective blocking or opening of the fluid connection to the at least one main working channel is allocated, wherein the shut-off valve device on the one hand is able to block the fluid connection if also the at least one main working channel is blocked by the interruption valve device and on the other hand is able to open the fluid connection if also the at least one main working channel is opened by the interruption valve device, and wherein the control valve means of the electropneumatic control unit are connected to the supply channel in order to feed in compressed air.

20. The pneumatic control device according to claim 16, wherein the electropneumatic control unit is designed as a control module that is detachably mounted on the functional assembly.

21. A process control device with a pneumatic actuator and with a pneumatic control device for the pneumatic actuator, wherein the pneumatic control device is mounted on the pneumatic actuator and wherein the pneumatic control device has a functional assembly having an interruption valve device for the selective opening in an open position or interruption in an interruption position of at least one main working channel used for the pneumatic control of the pneumatic actuator, wherein the functional assembly has a manually actuatable valve device connected to the interruption valve device by means of at least one auxiliary working channel, wherein the pneumatic actuator can be pneumatically controlled via the at least one auxiliary working channel by means of the manually actuatable valve device only when the at least one main working channel is interrupted by the interruption valve device, wherein air can be supplied to or removed from the at least one auxiliary working channel by actuation of the manually actuatable valve device when the interruption valve device is in the interruption position to pneumatically control the pneumatic actuator, and wherein the functional assembly further comprises a first actuating means separate from the manually actuatable valve device, the first actuating means being functionally connected to the interruption valve device for switching the interruption valve device to either the open position or the interruption position independent of the manually actuatable valve device, and without using the air which is supplied to or removed from the at least one auxiliary working channel via the manually actuatable valve device.

22. The process control device according to claim 21, wherein the pneumatic actuator is part of a process valve and is used to actuate a valve fitting of the process valve.

* * * * *